US009228280B2

(12) United States Patent
Bland

(10) Patent No.: US 9,228,280 B2
(45) Date of Patent: Jan. 5, 2016

(54) METHOD AND DEVICE FOR SEWING DESIGNS

(71) Applicant: Betty A. Bland, Mannington, WV (US)

(72) Inventor: Betty A. Bland, Mannington, WV (US)

( * ) Notice: Subject to any disclaimer, the term of this patent is extended or adjusted under 35 U.S.C. 154(b) by 114 days.

(21) Appl. No.: 14/096,975

(22) Filed: Dec. 4, 2013

(65) Prior Publication Data

US 2014/0150273 A1 Jun. 5, 2014

Related U.S. Application Data

(60) Provisional application No. 61/733,612, filed on Dec. 5, 2012, provisional application No. 61/747,952, filed on Dec. 31, 2012.

(51) Int. Cl.
*B43L 13/20* (2006.01)
*D05B 21/00* (2006.01)
*D05B 97/02* (2006.01)

(52) U.S. Cl.
CPC ..... *D05B 21/00* (2013.01); *D05B 97/02* (2013.01)

(58) Field of Classification Search
CPC ..... B05B 97/02; B43L 9/04
USPC ..... 33/11, 12, 17 A, 27.03, 565
See application file for complete search history.

(56) References Cited

U.S. PATENT DOCUMENTS 1,986,551 A * 1/1935 Anderson ..... 33/27.03
4,267,638 A 5/1981 Heinz
4,916,820 A * 4/1990 Kozyrski et al. ..... 33/27.03
5,347,721 A 9/1994 Asterino, Jr.
6,889,442 B2 5/2005 Bouvier
6,978,550 B2 12/2005 Xieh
7,255,051 B2 8/2007 Graham et al.
D557,623 S 12/2007 Haddadin
D567,684 S 4/2008 Haddadin
7,484,308 B2 2/2009 Stravitz
8,813,381 B2 * 8/2014 Platt ..... 33/12
2005/0252019 A1 11/2005 Gordon et al.
2009/0151175 A1 * 6/2009 Chen Lin ..... 33/30.4
2014/0060702 A1 * 3/2014 Adkins et al. ..... 33/27.03

OTHER PUBLICATIONS

YouTube, "Marilyn Badger Announces New Circle Maker," retrieved on May 23, 2014, retrieved from https://www.youtube.com/watch?v=vJGT0SrNjO4&feature=related, 2 pages.
Quilter's Rule, "Stitching a Baptist Fan using the Westalee Cross Hatch Ruler Base, Right Angle Tool, and Compass Arm," obtained from www.QuiltersRule.com, 2013, 7 pages.

(Continued)

*Primary Examiner* — G. Bradley Bennett
(74) *Attorney, Agent, or Firm* — Seed IP Group PLLC

(57) ABSTRACT

The present disclosure is directed to a device and method for guiding a hopping foot across material in a desired pattern using a manually positionable longarm sewing machine, the device having a rigid guide arm with opposing first and second planar sides, a plurality of notches formed in the edges of the guide arm, and at least one attachment point for mounting on the material. The attachment point can be a circular opening, and an anchor point in the form of a temporary disc affixed to the material is sized and shaped to be slidably received within the circular opening to provide a pivot point for rotation of the guide arm, and the notches are sized and shaped to slidably receive the hopping foot of the longarm sewing machine to guide the hopping foot across the surface of the material.

16 Claims, 9 Drawing Sheets

(56) References Cited

OTHER PUBLICATIONS

"Circleworks by Westalee Design," Sep. 24, 2010, 1 page.
YouTube, "Spin-E-Fex by Westalee Design," retrieved on Nov. 6, 2014, from http://www.youtube.com/watch?v=J5-8SNCMQOE, 1 page.
YouTube, "Circles on Quilts Rotating Templates," retrieved on Nov. 6, 2014, from http://www.youtube.com/watch?v=ptS6nLedtY4&list=UUCSAglxCVhtzoPSHNLJOqw, 1 page.
"Screen prints showing date of works and development," correspondence from Leonie West received by the USPTO Dec. 8, 2014, displaying images dated Aug. 30, 2010, Jan. 6, 2012 and Sep. 16, 2011.
"Spyro Quilter Template Instructions—Westalee Accessory Tool" Quilter's Ru1e™, no date provided, retrieved from http://quiltersrule.com/, 7 pages.
West, Leonie, "Templates for Quilting," Westalee Design catalog, 2012, 12 pages.
Westalee Design, "Circles on Quilts: Circles," instruction manual, 2012, 2 pages.
Westalee Design, "Circles on Quilts: Circleworks," instruction manual, 2010, 2 pages.
Westalee Design, "Spin-e-fex: Rotating templates to create rotating quilting patterns," instruction manual, no date provided, 2 pages.
Westalee Design, "Westalee Design Pin Lock System Design 2009 for your Circleworks tool," 2009, 2 pages.

* cited by examiner

METHOD AND DEVICE FOR SEWING DESIGNS

BACKGROUND OF THE DISCLOSURE

1. Technical Field

The present disclosure is directed to a device for use in forming quilted designs on fabric and, more particularly, to a tool for use with sewing and quilting machines in generating lines of stitching, particularly for guiding a sewing machine in a pattern such as a circle or an arc.

2. Description of the Related Art

Quilting as both a technique and an art form has developed over the millennia from hand stitching to modern machine sewing. While stitching has the utilitarian function of holding layers and segments of cloth together, it also provides a means of artistic expression through ornate designs along with fabric color and texture selection.

Machines for sewing quilts have been used since the 1800s. Adaptations over the years have resulted in the development of the longarm sewing machine, which has a longer reach and greater mobility than typical sewing machines.

The longarm sewing machine includes a large sewing head with a hopping foot extending downward to contact the fabric. The head is mounted for movement along a frame. Handles on the sewing head allow the operator to guide the hopping foot by hand across the fabric to create a stitching pattern. Some machines can be mounted on frames and robotically controlled, i.e., a computer controls movement of a carriage. More sophisticated (and expensive) machines utilize computers that is integral to the longarm machine itself and is configured to control functions such as pattern placement, stitching coordinates, size, and stitch length.

Tools have been developed to assist operators in manually guiding the sewing head. One example is a tool formed of an elongate bar or flat piece of rigid material that has handles attached at both ends. A centrally disposed slot is formed transverse to the longitudinal axis of the tool and is sized and shaped to accommodate the hopping foot. This "mini-handle" tool enables an operator to manually maneuver the sewing head across the fabric surface to create a desired stitching pattern.

As with other manual methods of guiding the sewing head, it is subject to operator error. When a pattern is applied to the fabric, the manual guiding method may require the operator to stand behind the machine and carefully guide the sewing head to trace or follow a preprinted or embossed pattern. As the operator must look at the pattern being traced and not at the actual stitching, broken or bunched thread, puckering, folds, misalignment, uneven stitching and other problems can go unnoticed. Alternatively, a freehand approach to creating a pattern while standing in front of the machine can be very difficult to execute when symmetry or repeated patterns are desired. In either case an error can be difficult to undo and, if left in the fabric, will result in an unsightly appearance. For example, many noted patterns utilize a series of concentric circles or arcs. Manually following a tracing of the circles or arcs from behind the machine requires the operator to repeatedly stop the machine and make visual contact with the hopping foot and the stitching line, resulting in frequent stopping and starting of the machine as the operator moves around to maintain a line of sight.

Hence, there is a need for a device that can assist the operator in moving the hopping foot in the desired pattern across fabric or other material when the sewing machine head is manually positionable with the work area completely visible and accessible.

BRIEF SUMMARY OF THE DISCLOSURE

In accordance with the present disclosure, a device for guiding a hopping foot across material in a desired pattern using a manually positionable longarm sewing machine is provided. The device includes a rigid substrate, preferably transparent, having opposing first and second planar sides, one of which comprises a working surface that bears against the material, a plurality of notches formed in the substrate, and at least one attachment point on the substrate to couple to a fixed point on the material. Ideally the attachment point is a circular opening and the fixed point is a temporary disc affixed to the material that is sized and shaped to be slidably received within the circular opening. Alternatively, the anchor post and corresponding opening can have other geometric shapes, such as square, triangular, keyhole, etc., to hold a template in place and prevent rotation.

In accordance with another aspect of the present disclosure, the notches are sized and shaped to slidably receive the hopping foot of the longarm sewing machine.

In accordance with yet a further aspect of the present disclosure, the device has a plurality of notches formed on opposing edges of the device.

In accordance with another embodiment of the disclosure, a method of using a device for guiding a hopping foot across material in a desired pattern using a manually positionable longarm sewing machine is provided. Preferably the material is fabric such as cloth. The method includes providing an attachment point on the material, coupling the device to the attachment point, positioning the hopping foot in an at least one notch in the device, and manually moving the longarm sewing machine head across the material in accordance with the movement of the device about the attachment point. Ideally the device is structured to guide the hopping foot in an arcuate path having a radius defined by the distance of the notch from the attachment point to complete either an arc of a desired length or a complete circle of radius defined by the distance of the notch from the center point.

In accordance with another aspect of the present disclosure, the attachment point is a disc-shaped object having a top surface and a working surface, and further including at least one prong extending from the working surface that is structured to engage the material and hold the disc-shaped object to the surface of the material.

As will be readily appreciated from the foregoing, the present disclosure avoids the disadvantages of prior methods and achieves a device that readily mounts on the material and guides the hopping foot across the surface of the fabric to follow a desired pattern. The operator can maintain manual and visual contact with the working area and template at all times. The attachment point is readily and removably mounted on the fabric without damage or alteration to the fabric while providing an immovable pivot point for the rotatable guide arm. Multiple engagement points on the guide arm provide for arcs and circles of selectable radius, facilitating repeatability of any pattern requiring an arc or circle stitch pattern.

BRIEF DESCRIPTION OF THE DRAWINGS

The foregoing features and advantages of the disclosed embodiments of the disclosure will be more readily appreciated as the same become better understood from the following detailed description when taken in conjunction with the accompanying drawings wherein.

DETAILED DESCRIPTION OF THE DISCLOSURE

Figure 1:
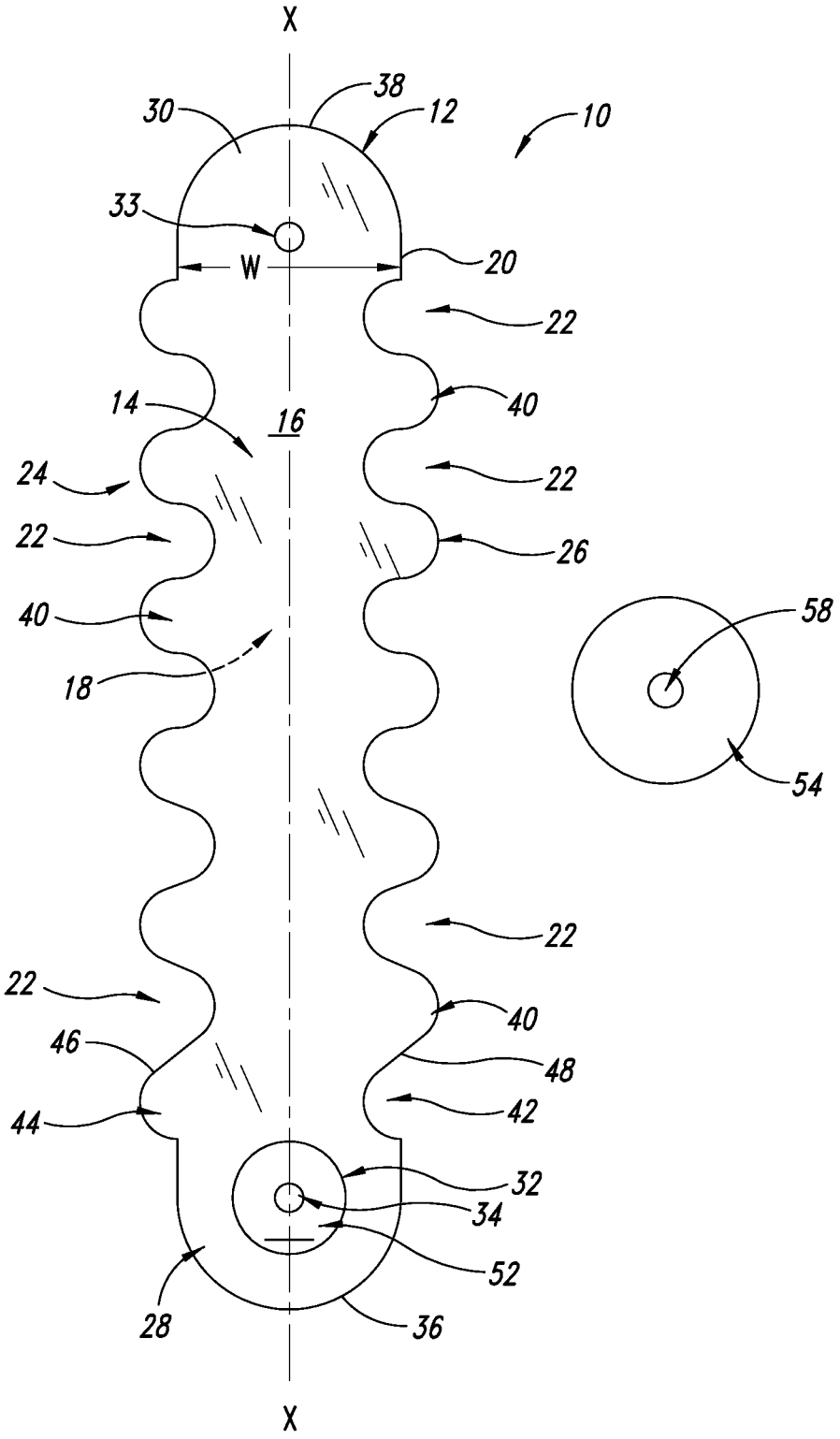
FIG. 1 is a bottom plan view of a circle guide and anchor assembly partially assembled in accordance with the present disclosure.
Figure 2:
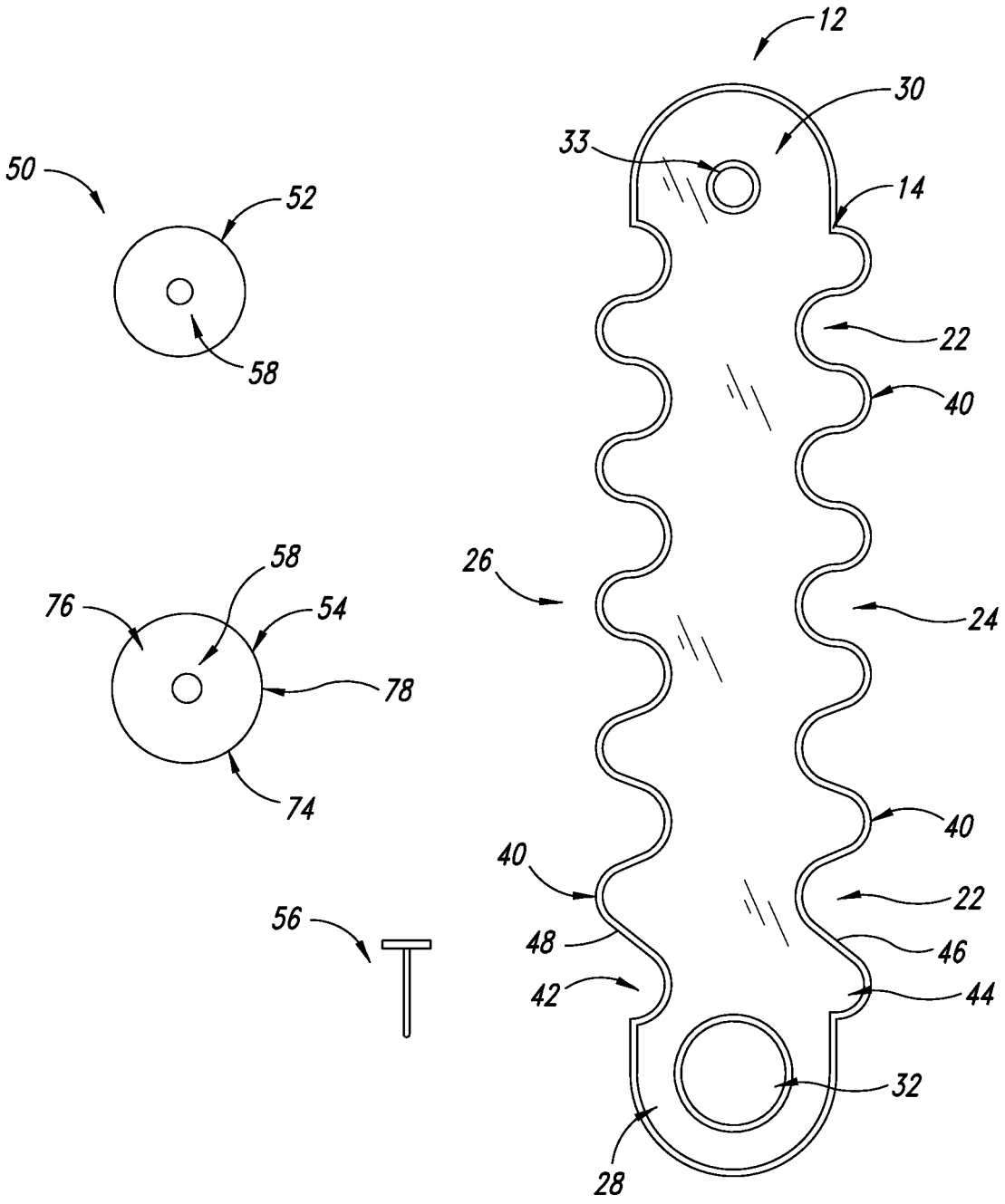
FIG. 2 is a top plan view of the circle guide and anchor assembly of FIG. 1 fully disassembled.

In the following description, certain specific details are set forth in order to provide a thorough understanding of various embodiments of the disclosure. However, one skilled in the art will understand that the disclosure may be practiced without these specific details. In other instances, well-known structures associated with construction techniques have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size.

In the drawings, identical reference numbers identify similar elements or acts. The size and relative positions of elements in the drawings are not necessarily drawn to scale.

In accordance with one aspect of the present disclosure, a tool 10 is provided that includes a circle guide arm body 14 formed of an elongated flat sheet of rigid, and preferably transparent, material having first and second opposing sides 16, 18. The first side 16 is considered the bottom side and the second side 18 has a substantially planar surface. The guide arm body 14 has a thickness defined by a circumscribing edge 20 that interfaces with the first and second opposing sides 16, 18. At least one and preferably a plurality of notches 22 are formed on first and second opposing sides 24, 26 of the guide arm body 14.

Ideally the notches 22 extend inwardly towards a longitudinal central axis X of the guide arm body 14 in the on two sides in periodic increments. A proximal end 28 and a distal end 30 are formed at the longitudinal ends of the guide arm body 14, each end 28, 30 having a first width W that is the same dimension and having an arcuate plan form shape with the same radius of curvature. An opening 32 is formed in the proximal end, preferably of a circular plan form shape with a radius of curvature centered at a center point 34 that is coincident with a center point for the radius of curvature for the arcuate proximal end 28.

In one embodiment, the overall length of the guide arm body 14 is in the range of 7 to 9 inches and preferably 8.00 inches to 8.012 inches. The width W at the proximal and distal ends as measured through the center point 34 for the arc-shaped ends is in the range of 1 to 2 inches and preferably 1.5 to 1.512 inches. At the proximal end 28 the center point 34 is located inward from a terminal edge 36 at the proximal end and from a terminal edge 38 at the distal end of the guide arm body 14 in the range of 0.7 to 0.8 inches and preferably 0.756 inch. In other words, this would be the radius for the curvature of the proximal end 28 and similarly for the distal end 30. The diameter of the opening 32 in the proximal end 28 is in the range of 0.7 to 0.8 inches and more preferably about 0.762 inch.

An optional opening 33, such as one used as a hanging hole that allows the tool to hang on a hook, can be formed in the distal end 30, and it has a diameter in the range of 0.3 to 0.4 inch, and more preferably a diameter of about 0.313 inch.

With respect to the notches 22, each notch 22 has a rounded planform shape that is preferably a half circle. Each half circle has a width in the range of 0.5 to 0.6 inches and preferably 0.505 inch, meaning it has a radius of curvature of about 0.2525 inch. Between each notch 22 is a corresponding projection 40 having a rounded planform shape, preferably in the shape of a half circle with a similar radius and size as the notch 22 described above. However, the positioning of the notches 22 and projections 40 relative to the longitudinal side edge 20 is offset. In other words, in one representative embodiment, the notch 22 extends into the guide arm body 14 about 0.244 inch while the corresponding projection 40 extends away from the guide arm body 14 about 0.256 inch from the corresponding side edge 20.

Ideally, a notch 22 formed on the right side 24 of the guide arm body 14 is opposite a corresponding projection 40 on the opposite or left side 26 of the guide arm body 14. Thus, with this construction, each of the notches 22 and projections 40 are spaced equidistantly on their respective sides 24, 26.

However, the notch 42 adjacent the proximal end 28 on the right side 24 of the guide arm body 14 and the projection 42 adjacent the proximal end 28 on the left side 26 of the guide arm body 14 are further away from the corresponding projections and notches on the same side due to extended spacing. In other words, the transitional edge 46 between the notch 22 and the projection 44 is at more of an acute angle with respect to the longitudinal axis X than the other transitions. Similarly, the transitional edge 48 between the projection 40 and the notch 42 is at a more acute angle with respect to the longitudinal axis than are the other transitions on the same side 26 of the body 14. Hence, the notch 42 and the projection 44 do not have the entire half circle planform shape as the corresponding structures on the guide arm 14. This is for the purpose of preventing the hopping foot from slipping out of the notch that is closest to the pivot point. It was found that if the notch was configured to match the shape of the ones preceding it, the tight radius within which the tool and hopping foot must work creates a force on the hopping foot that urges it out of the notch. A unique anchoring system provides an easy-to-attach and remove pivot point for the guide arm 14. As shown in FIGS. 2-5, an anchoring system 50 is provided that includes an anchor post 52 and anchor cap 54 along with a stabilizing pin 56. Both the anchor post 52 and the anchor cap 54 have magnets 58 embedded therein, preferably rare earth magnets, that are configured to retain the anchor cap 54 on top of the anchor post 52 as shown in FIG. 6.

Figure 4:
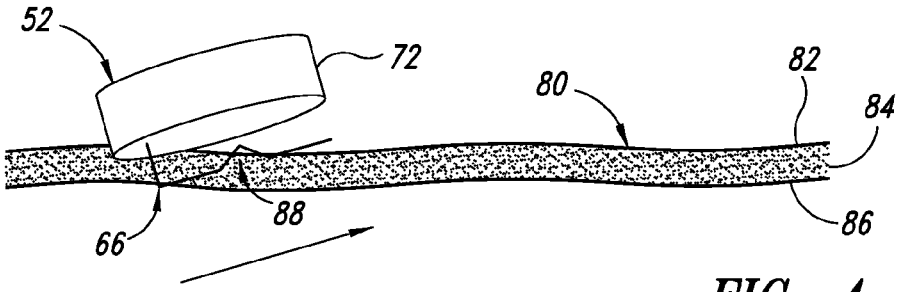
FIG. 4 is a side view of the anchor post of FIG. 3 inserted into the multilayer material.
Figure 5:
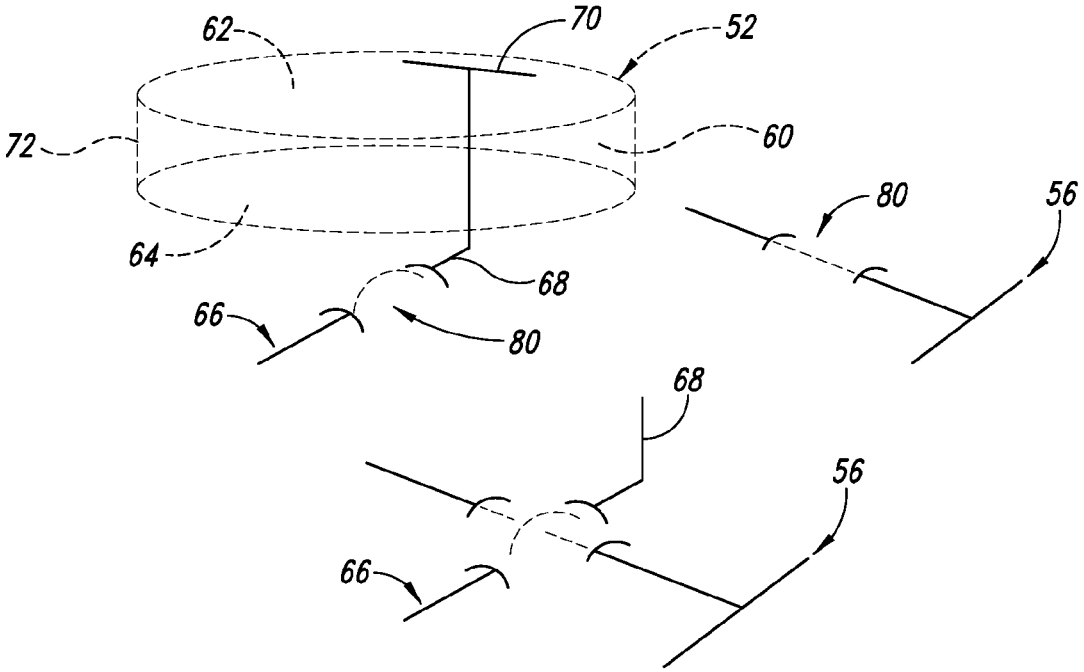
FIG. 5 is an isometric view of the anchor post and stabilizing pin attached to the multilayer fabric.
Figure 6:
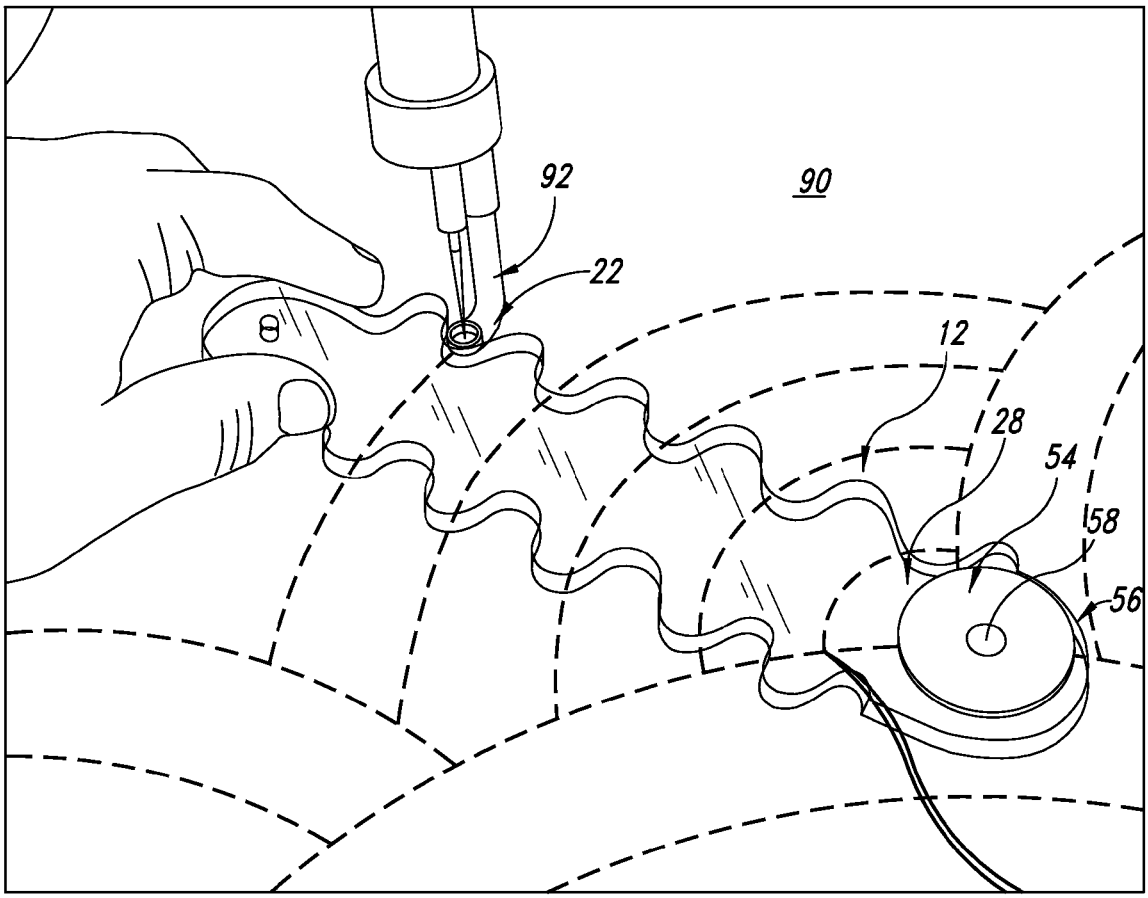
FIG. 6 is an isometric view of the guide arm engaged with a hopping foot of a longarm sewing machine and fastened to the surface of the material to be quilted, such as a fabric cloth.

The anchor post 52, shown more clearly in FIG. 5, has a disk-shaped body 60, preferably formed of acrylic, that is sized and shaped to be received within the opening 32 formed in the proximal end 28 of the guide arm body 14. Ideally, the anchor post body 60 has a thickness that is no greater than a thickness of the guide arm body 14. For example, the anchor posts are ¼inch thick, which is the same as the guide arm body 14. However, this thickness can vary, such as down to ⅛ inch thick while the guide would remain thicker. The anchor post body 60 has top and bottom mutually opposing planar surfaces 62, 64 with a prong 66 extending from the bottom surface 64. As shown in FIG. 5, the prong 66 has a T-shaped configuration with a stem 68 extending from the body 60 and a crossbar 70 embedded with a portion of the stem 68 within the body 60. Thus, the stem 68 forms the prong portion 66 of the anchor post 52. Preferably the portion embedded within the anchor post body 60 is offset from the center so that the prong 66 can extend across a diameter of the anchor post 52, and terminate, preferably no further than the edge 72 of the anchor post body 60 as shown in FIG. 4.

The anchor cap 54 is similarly shaped to the anchor post 52 in that it has a disk-shaped body 74 that is preferably formed of acrylic and has the magnet 58 embedded therein. However, the anchor cap 54 has a diameter larger than the diameter of the opening 32 in the guide arm body 14 in order to retain the guide arm body 14 in engagement with the anchor post 52. The anchor cap 54 preferably has mutually opposing planar top and bottom sides 76, 78 with the magnet 58 having a portion that extends out of the top side 76, which is shown more clearly in FIG. 6. The extending portion of the magnet 58 can function as a handle to facilitate attachment and removal of the anchor cap 54 to the anchor post 52.

Figure 3:
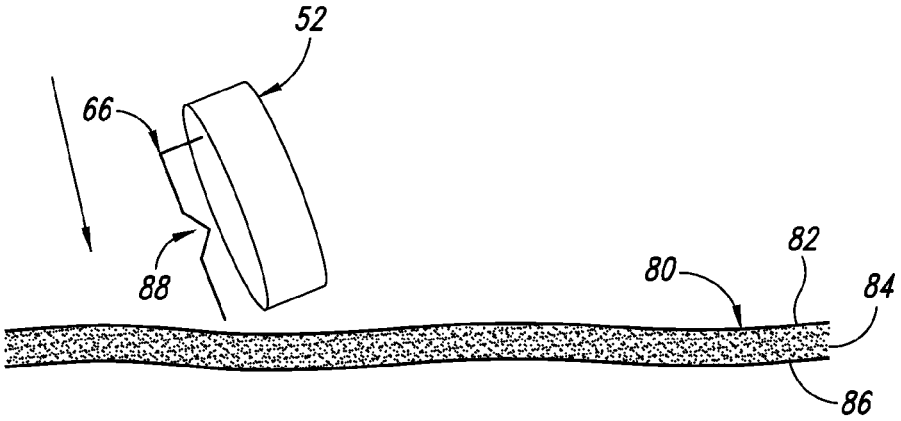
FIG. 3 is a side view of the first step in attaching the anchor post to a multilayer cloth material.

In use, reference is made to FIG. 5 which shows the anchor post 52 attached to fabric 80, such as cloth to be quilted, shown in more detail in FIGS. 3 and 4. More particularly, the fabric 80 has a top layer 82 (top), middle layer 84 (batting), and bottom layer 86 (backing). As shown in FIG. 3, the anchor post 52 is positioned above the top layer 82 of the cloth 80 with the prong 66 pointed towards the top layer 82. The prong 66 is then inserted through the cloth 80 to come out the third layer or bottom 86, and then turned to extend back into the middle layer 84 and, preferably, back out the top layer 82, as shown in FIG. 5. However, it is possible to attach the anchor post 52 by inserting the pin through only the top layer 82 or only the top layer 82 and the middle layer 84, which may be sufficient to provide enough support for the anchor post 52. To stabilize the anchor post 52 in place on the cloth, a T-shaped pin 56, identified in FIG. 5 as a stabilizing pin, is inserted into the cloth 80 and below the prong 66 to extend out again of the cloth 80.

In a preferred embodiment, the prong 66 has a U-shaped notch 88 formed at a central location in the stem portion 68 through which the stabilizing pin 56 extends when mounted on the cloth 80. In this manner, the stabilizing pin 56 locks the prong 66, and hence the anchor post 52, in place on the cloth 80.

In summary, the anchor post 52 is moved into a desired position over the cloth 80 with the prong 66 pointing down towards the cloth 80. The anchor post 52 is then lowered onto the cloth 80 so that the prong 66 pierces all layers of fabric, including the middle layer or batting 84 and the backing layer 86, or only the top layer 82 or only the top and middle layers 82, 84.

The edge of the anchor post 52 is gently rotated back a little further than level, and then brought back up to level while pulling slightly forward in a scooping motion to seat the prong 66 in the cloth 80. Care should be taken to ensure that the anchor post 52 is properly positioned. When properly positioned, the prong 66 will be seated in the fabric 80 under the anchor post body 60 with the end of the prong 66 visible on the top layer 82 of the fabric or cloth 80.

For extra security, the stabilizing pin 56 should be used by inserting it into the cloth 80 under the anchor post prong 66 and then back up on top of the fabric 80. Thus, both ends of the stabilizing pin 56 will be on top of the fabric 80. Next, the guide arm 14 is positioned over the anchor post 52 with the opening 32 at the proximal end 28 placed over the anchor post 52 so that the guide arm body 14 is flat on the cloth 80. The top side 18 of the guide arm body 14 should be flush with the top surface 62 of the anchor post 52. If a ⅛ inch thick disk is used, its top will be positioned slightly below the top side 18 of the guide arm 14. When the quilting layers are too thin to hold the anchor post in place, a small square or round of padding (such as felt) may be used on top to give extra stability. The ⅛ inch thick anchor post will be used with the padding, and the prong and stabilizing pin is inserted through it and the fabric material below it. In this instance, the top of the ⅛ inch disk will be flush or slightly lower than the top side 18 of the guide arm body 14.

To ensure proper mounting, the guide arm body 14 should be gently rotated from side to side about the anchor post 52 to ensure it moves easily across the fabric surface without putting stress on the anchor post 52 or the fabric 80. The anchor cap 54 can then be placed over the anchor post 52 to overlap over the guide arm body 14 as shown in FIG. 6.

Turning next to FIG. 6, a sewing or marking device can be moved into position, nestled within one of the notches 22 on either of the sides 24, 26 of the guide arm body 14. Physical contact should be maintained between the guide arm body 14 and a device 90 as shown in FIG. 6, such as a hopping foot 92. The guide arm body 14 should be rotated together with movement of the device in the desired direction for a desired distance.

As with any tool used in ruler work, the guide arm body 14 should be held stable near the hopping foot 92 of the machine device 90 shown in FIG. 6 to prevent excess vibration. Care should be taken to keep fingers away from the needle in the hopping foot 92.

To remove the guide arm body 14 and anchoring system 50 from the cloth 80, the anchor cap 54 should be slid to the side to break the magnetic connection between the anchor cap 54 and the anchor post 52. After the anchor cap 54 is removed, the guide arm body 14 can be lifted up and off the anchor post 52. The stabilizing pin 56 is then removed, and the anchor post 52 is tilted down towards a free end of the prong 66 and moved backwards and up until the prong 66 is out of the cloth

80. The entire system or tool 10 can then be repositioned at another location on the cloth 80.

As will be readily appreciated, the tool 10 formed in accordance with the present disclosure enables a user to perform all work on the top of the cloth 80 directly in the stitching area. Nothing under the cloth or quilt is present to hinder the stitching operation. Although the prong is under the quilt, it is flat and should not present an obstacle. No additional templates or tools are required. Thus, continuous line stitching is possible with less tie-offs, and all the work can be done completely at the front of the machine and not behind. With the tool disclosed herein, circles or arcs in any direction can be made. The tool 10 can be easily repositioned on the cloth 80 in different areas so that arcs and circles can be stitched in place where desired.

This assembly makes possible stitching or marking of accurate circles or arcs on a flexible fabric mounted flat in a stationary frame. By means of the single prong with a sharp point, the guide's anchor post is affixed through and remains stationary above the fabric, and the guide end hole is seated over and is preferably level with the anchor post, which allows the guide to rotate freely across the surface of the fabric. In this position, the guide can move in either direction completely around the anchor post depending on the available workspace.

This guide has along two sides a plurality of guide notches into which fits another device, such as a quilting machine hopping foot or a marking instrument. The guide and the other device are moved together across the surface of the fabric to create a circular pattern.

Figure 7:
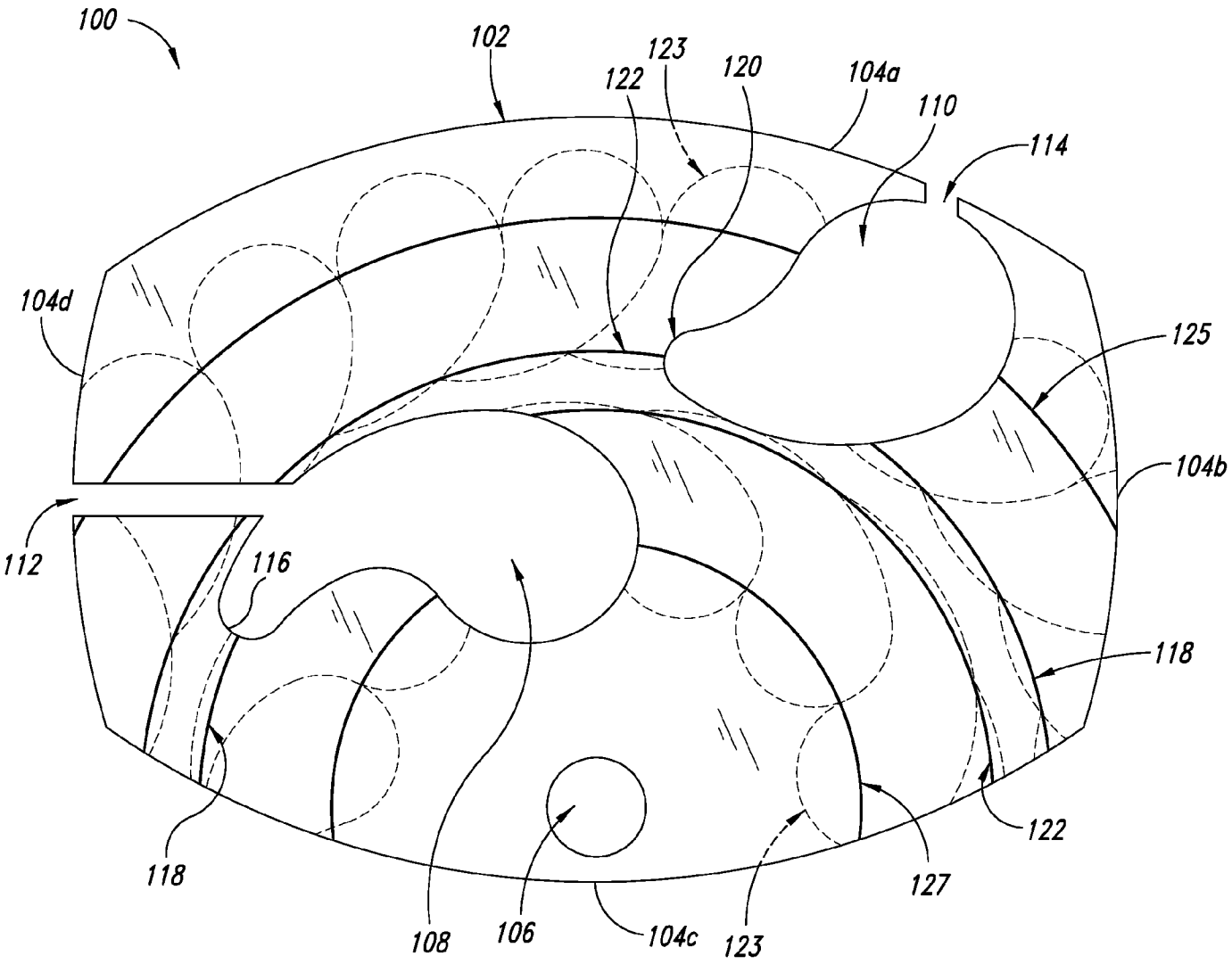
FIG. 7 is a top plan view of a feather wreath template formed in accordance with the present disclosure.

Referring next to FIG. 7, shown therein is a top plan view of a feather wreath template 100 having a body 102 formed of clear, transparent material, preferably a plastic type material, that is rigid. Ideally the thickness is in the range of one-quarter inch (¼") to five-eighth's inch (⅝") with a preferred thickness of ¼inch in order to prevent the template 100 from sliding under the hopping foot. The template 100 has a somewhat rectangular shape, having four side edges 104*a-d*, with two opposing edges at the top side 104*a* and bottom side 104*c* being longer than two opposing side edges on the right side 104*b* and left side 104*d*. Each of the four side edges 104*a-d* is convex instead of straight.

Near the bottom side edge 104*c* is a circular opening 106 formed completely through the body 102. The opening 106 is sized and shaped to be rotatably mounted over an anchor post, such as anchor post 52 described above.

Two additional openings are formed in the body 102, a large teardrop opening 108 near the left side edge 104*d* and a smaller teardrop opening 110 near the top adjacent the right side edge 104*b*. Each of the two teardrop shaped openings 108, 110 has a passage 112, 114, respectively, that communicates with the nearest side edge 104*d*, 104*a* respectively. Ideally, the passages 112, 114 are one-quarter inch (¼") wide, which in accordance with one aspect of the present disclosure, permits the hopping foot to be inserted into the template or allow the template to be slide up over the shaft of the hopping foot in order to facilitate stitching inside the teardrop openings 108, 110.

The large teardrop opening 108 curves toward the bottom side edge 104*c* while the smaller teardrop opening 110 curves upward towards the top side edge 104*a*. The smaller end 116 of the large teardrop opening 108 terminates on a first concentric arc 118 and the smaller end 120 of the smaller teardrop circle 110 terminates on a second concentric arc 122 that has a larger radius than the first concentric arc 118. Both arcs 118, 122 share the center point of their respective radius with the center point of the circular opening 106. These two arcuate lines 118, 122 are marked on the back surface of the template to provide a visual indication to the user of a temporary line where stitching begins and ends.

Also shown on FIG. 7 are optional arcuate lines 125 and 127 appear above and below the arcs 118, 122, respectively. These two lines 125, 127 have the same center point as arcs 118, 122. They are provided to assist the quilter with other designs. One example is stitching only the outside edges of the teardrops to make a scalloped line or other designs.

Outline markings 123 of the teardrop shapes or sections appear on the back surface of the template body 102 to provide a visual guide to the quilter in proper placement of the template 100 relative to the design and to facilitate the correct positioning of the stitched pattern in the fabric material beneath the template 100. Also, fill patterns might also be used alone or with the outlines for the same purpose. When the template 100 is rotated around the anchor point, the outline markings 123 line up with previous stitched teardrops in the underlying fabric.

In use, the feather wreath template is easily mounted to the work piece, such as a piece of cloth using the anchoring system of the present disclosure. The following steps illustrate one manner of use:

1. Fasten anchor post in place on a work piece, such as a piece of cloth; place feather wreath template 100 over anchor post; attach anchor cap.

2. Move hopping foot through the passage 112, 114 into the respective feather section cut out or teardrop shaped opening 108, 110. Bring up and tie off the thread in smaller end 116, 120 (this is the starting point).

3. Stitch counterclockwise around inside of section 108 or clockwise inside section 110 back to starting point, and then continue stitching over previous stitching to the small end 116, 120 of the teardrop shaped opening 108, 110. Stop with needle down in the small end and rotate template clockwise so that outline markings 123 align with previous stitching. Repeat.

4. Rotate and align template 100 as needed to adjust the last feather section, tie off and cut thread.

5. Without removing the anchor post 106 from the cloth or fabric, gently lift the template 100 off the anchor post 106 and reposition the hopping foot into remaining teardrop shaped opening 108 or 110. Reposition the template 100 over the anchor post 106. Repeat the stitching pattern using the other of the teardrop shaped opening 108, 110. Preferably, the inside larger teardrop shaped openings 108 are done first, followed by the outside teardrop shaped openings 110 in the same way.

Figure 8:
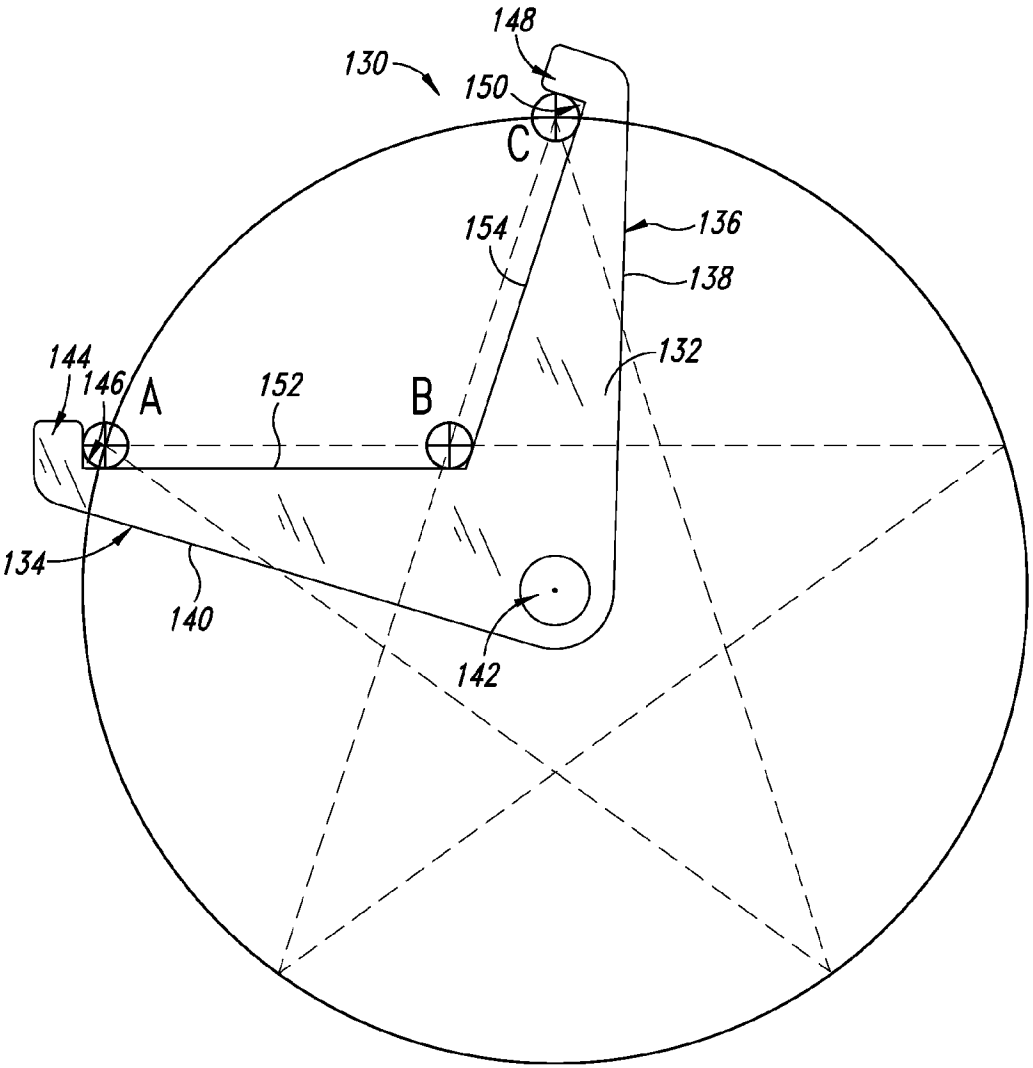
FIG. 8 is a top plan view of a five point star template formed in accordance with the present disclosure.

Shown in FIG. 8 is a five point star template 130 formed in accordance with the present disclosure. This template 130 has a body 132 that is preferably formed of clear, transparent plastic material as the prior template with the same materials and thickness, although other materials and dimensions can be used. The template 130 has two arms 134, 136 formed at an acute angle of 72 degrees when measured along the outside edges 138, 140. A circular opening 142 is formed in the body 132 at the intersection of the two arms 134, 136. This opening 142 is sized and shaped to be used with the anchor system of the present disclosure and in the same manner as described in connection with other embodiments. It is to be understood that the outside perimeter can be any shape or size, including a circle with the interior angle removed. A prominent feature of the star templates is the stitching line A through C and the distance of those three points from the center of the anchor post.

As shown in FIG. 8, the left arm 134 terminates in an L-shaped distal end 144, forming a first interior right angle corner 146. Similarly, the right arm 136 terminates in an L-shaped distal end 148, forming a second interior right angle corner 150 that faces the first interior right angle corner 146. It is to be understood that the interior corners 146, 150 can have other than a right angle shape so long as the shape accommodates the hopping foot of the machine. Interior corners 146, 150 serve as pivot points to rotate the template during use.

Also as shown in FIG. 8, the inside edge 152 of the left arm 134 intersects with the inside edge 154 of the right arm 136 at an obtuse angle. For a five point star this angle is about 108 degrees.

Figure 9:
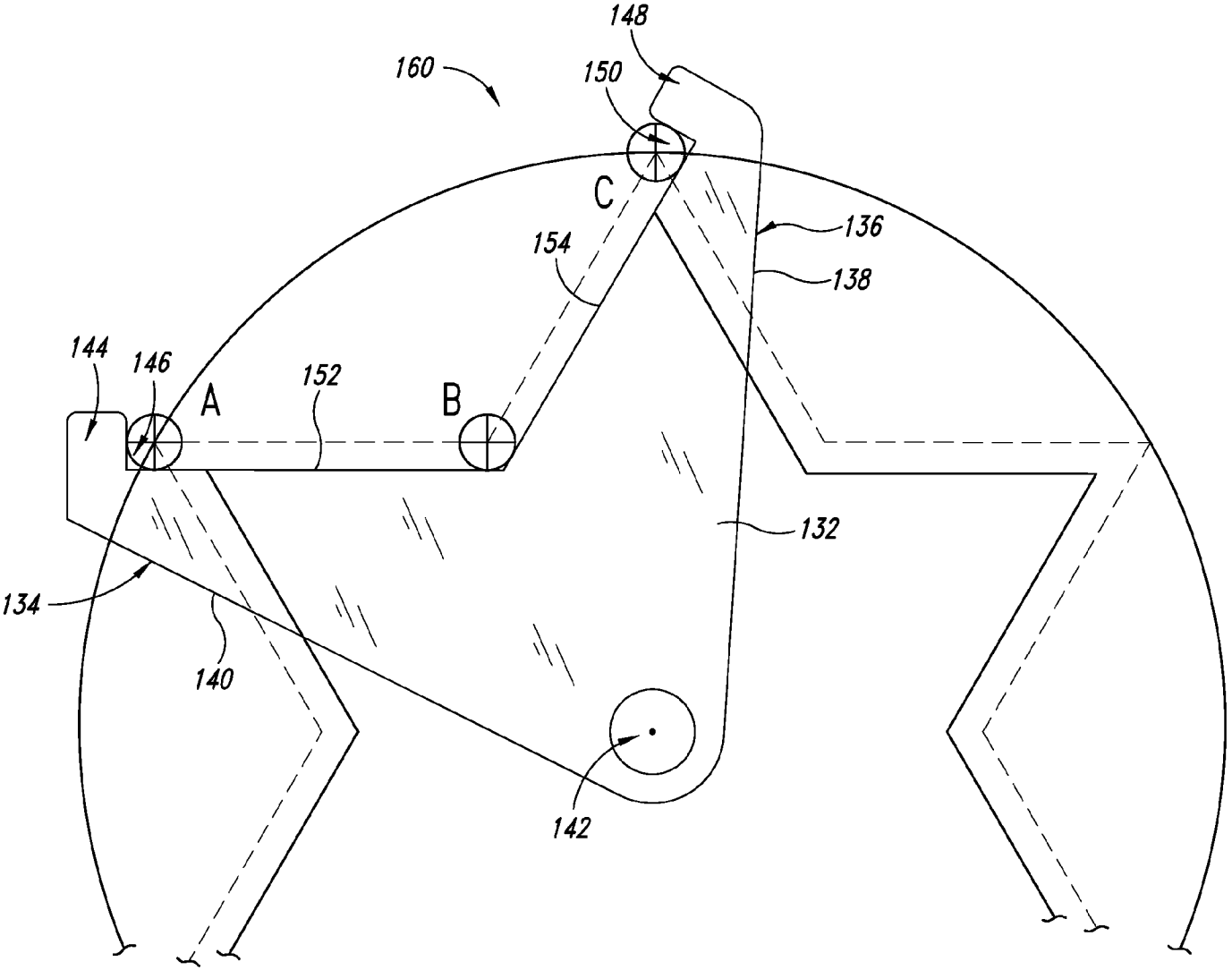
FIG. 9 is a top plan view of a six point star template formed in accordance with the present disclosure.

FIG. 9 shows a six point star template 160 having a similar shape to the five point star template 130. For convenience, the same elements of these two templates bear the same reference numbers. In the six point star template 160, the inside edges 152, 154 meet at an obtuse angle of about 120 degrees while the outside edges meet at an acute angle of about 68 degrees.

The directions for use of these two templates 130, 160, are as follows:

1. Fasten anchor post in place in fabric, place the opening 142 of the star template 130, 160 over the anchor post, and attach the anchor cap.

2. Stitch from pivot point A to pivot point C; needle down at point C.

3. Rotate the template 130, 160 clockwise about the anchor post until point A rests against hopping foot.

4. Stitch from point A to point C as before, repeating around and back to starting point to complete the star.

It is to be understood that the foregoing description and accompanying illustrations in FIGS. 8 and 9 are for the most common five and six pointed stars, and that stars having from three to twelve points with various sharpness of the points can be made by reference to the description herein. The templates, design and instructions are essentially the same, with the only major differences being the combinations of the angle of point B, point B's distance from the center of the anchor post, and the distance between points A & C.

Figure 10:
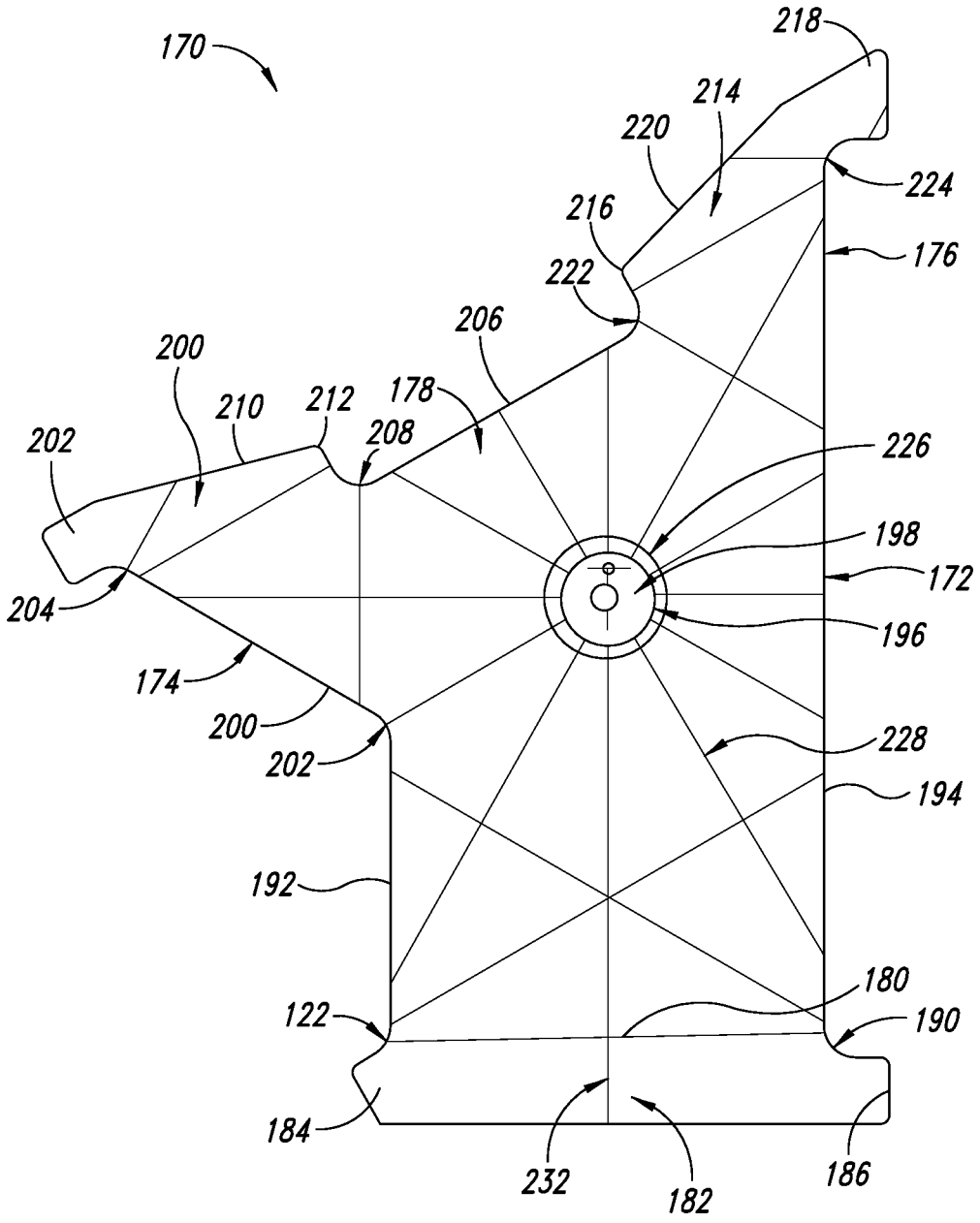
FIG. 10 is a top plan view of a multi-shape template formed in accordance with the present disclosure.

FIG. 10 is a top plan view of a multi-shape template 170 configured for use with the top anchor system 172 formed in accordance with the present disclosure. The template 170 includes an elongate body 172 with first and second arms 174, 176 extending from a top 178. At a bottom 180 is formed a first foot 182 having first and second extensions 184, 186 that form first and second pivot points 188, 190 adjacent respective sides 192, 194. A central opening 196 provides a point of attachment for the anchor 198 to underlying fabric, and a cap 226 snaps in place over the anchor post 198 and the template 170.

The first arm 174 includes a straight side 200 that intersects with the first side 192 to form an obtuse angle with a rounded vertex 202. A second foot 200 is formed on the terminal end of the first arm 174 and includes a first extension 202 that cooperates with the first straight edge 200 to form a third pivot point 204. The second foot 200 also has a second straight edge 210 that terminates at a second extension 212 that cooperates with a top edge 206 to form a fourth pivot point 208.

The second arm 176 has a third foot 214 that has first and second extensions 216, 218 connected by a second straight edge 220. The first extension 216 meets the top edge 206 to form a fifth pivot point 222, and the second extensions 218 meets the second side 194 to form a sixth pivot point 224.

All six pivot points 188, 190, 204, 208, 222, and 224 have adjacent sides that meet at a point of intersection, which has a rounded or concave planform shape. With respect to the second, fourth, fifth, and sixth pivot points 190, 208, 222, 224, the two sides form about a 90 degree angle whereas the remaining first, and third pivot points 188, 204, have sides that form an obtuse angle.

Ideally the multi-shape template is formed of clear, transparent acrylic or other similar material, with a thickness in the range as disclosed in previous aspects of the present disclosure described above.

Figure 11:
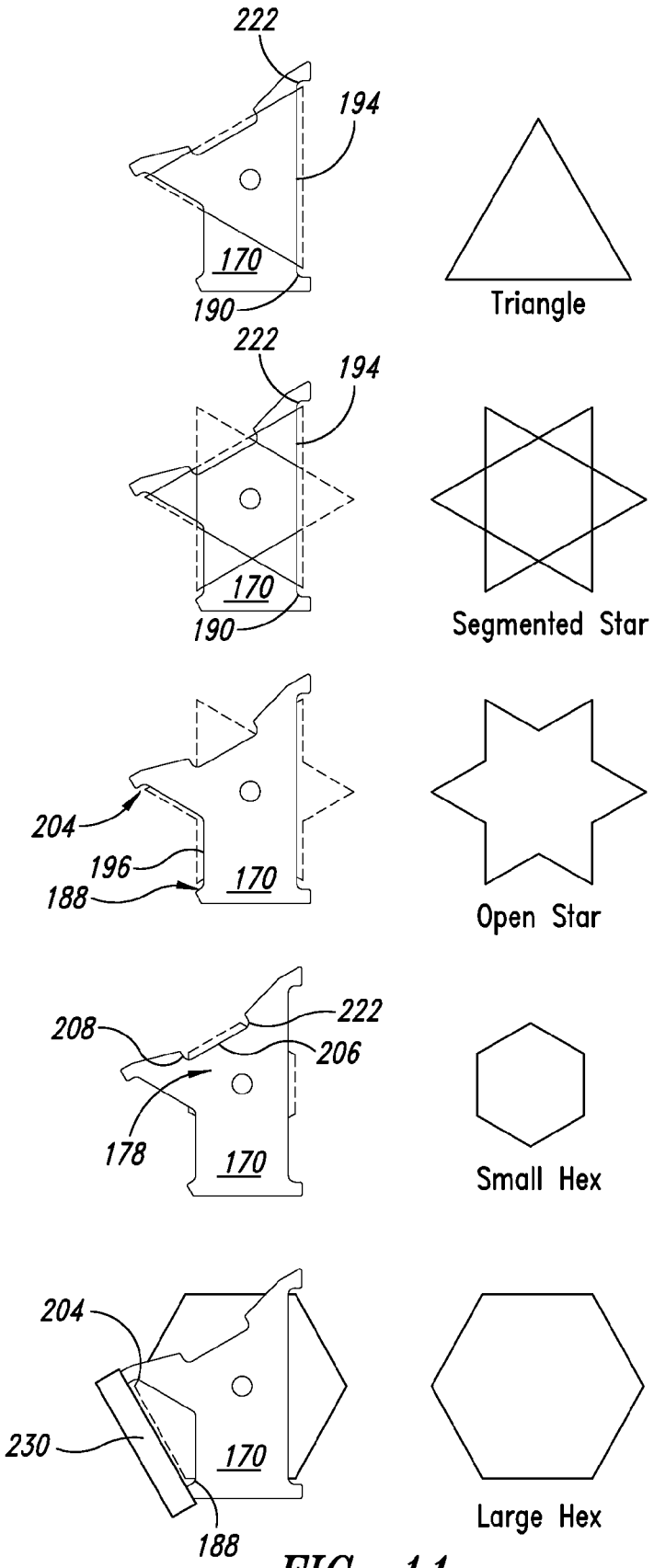
FIG. 11 is an illustration of various shapes that can be formed using the multi-shape template of FIG. 10.

As shown in FIG. 11, the multi-shape template 170 enables a user to create a variety of patterns, some in different sizes, including a triangle, two overlapping triangles forming a 6-pointed star with interior lines and a 6-pointed star with only exterior lines, as well as a small and large hexagon. To the left of each geometric shape is an illustration of which side of the multi-shape template 170 to use for drawing one or more segments of each shape. Instructions for using the template 170 to form each of the six shapes follow below with respect to FIGS. 10 and 11.

As shown in FIG. 10, position the template 170 with the opening 196 over the anchor post 198. Rotate the template 170 gently to make sure it moves easily back and forth without putting stress on the anchor post 198 or fabric to which the anchor post 198 is attached (not shown). Snap the cap 226 in place over the anchor post 198 and template 170.

Move hopping foot into position at either pivot point of chosen stitching path. Bring up thread and tie off.

Stitch a length of stitching path. Stop at a pivot point with the needle down. Rotate the template 170 until the hopping foot is seated in a pivot point at the beginning of the next stitching path, lining up markings 228 on the template line with previous stitches.

Continue stitching around entire triangle, star or hexagram.

For multiple designs in the same space (such as a small hexagram inside a large hexagram), without moving the anchor post 198, line up the markings 228 on the template 170 with previous stitching. Stitch as before.

Open Star:

Using a stitching guide on the left side 192 of the template 170, stitch from one pivot point 188 to the next pivot point 204. Stop with the needle down, rotate the template 170, and stitch the next line the same way. Repeat around until the design is complete.

Large Hexagram:

Using the stitching guide on the left side of the template 170, place another straight edge template 230 across an opening between the first extension 202 on the second foot 200 on the first arm 174 and the first extension 184 on the first foot 182 as shown. Use this to guide the hopping foot and stitch from one pivot point 188 to the next pivot point 204 across the opening. Stop in the second pivot point 204 with the needle down, rotate the template 170, and stitch next line the same way. Repeat around until the design is complete.

Small Hexagram:

Using the stitching guide 206 at the top 178 of the template 170, stitch from one pivot point 208 to the other pivot point 222. Stop with the needle down, rotate the template 170, and stitch the next line in the same manner again. Repeat around until the design is complete.

Triangle:

Using the stitching line 194 on the right side of the template 170, stitch from the upper pivot point 224 to the next pivot point 190, or vice versa. Stop with the needle down, rotate the template 170, and stitch the next line the same way. Repeat around until the design is complete.

Segmented Star (Two Opposing Triangles):

To make the first triangle, use the stitching guide 194 on the right side of the template 170 to stitch from one pivot point 224 to the next pivot point 190 or vice versa. Stop with the needle down, rotate the template 170, and stitch the next line in the same manner. Repeat around to start of stitching.

To make the second reversed triangle over first, backtrack the needle on the last line stitched, about one-third of the way, to the marking 232 on the first foot 182 at the bottom 180 of the template 170. Rotate the template 170 and line up the markings with the previous stitching. Stitch from one pivot point 224 to the next pivot point 190, rotate the template 170, and continue stitching as before. Repeat around until the design is complete.

The various embodiments described above can be combined to provide further embodiments. Aspects of the embodiments can be modified, if necessary to employ concepts of the various patents, application and publications to provide yet further embodiments. For example, it is possible that various shapes can be incorporated into the wreath template, such as botanicals, symbols, children, animals, toys, sports items, hearts, buildings, angels, abstract designs, etc.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An assembly for guiding a line of stitching across the surface of material in a desired pattern using a sewing or quilting machine, the assembly comprising:

a rigid guide arm having opposing first and second sides, one of which comprises a planar working surface structured to bear against the surface of the material, the guide arm having an elongate configuration with opposing edges, the guide arm including:

a plurality of notches formed in at least one edge of the opposing edges, at least one of the notches structured to engage a ruler foot on the sewing machine; and at least one attachment point on the guide arm;

a stabilizing pin; and an anchor member structured to be releasably coupled to the material and to be releasably coupled to the guide arm at the attachment point to provide a pivot point for the guide arm to rotate about the anchor member, the anchor member including a prong extending therefrom, the prong having a notch sized and shaped to receive the stabilizing pin and lock the prong and the anchor member in place on the material.

2. The assembly of claim 1 wherein the guide arm is formed of transparent material.

3. The assembly of claim 1 wherein the prong extends from a bottom surface of the anchor member and has an "L" shape comprising an extension leg and an engagement foot extending at an angle from the extension leg, the extension foot including the notch.

4. The assembly of claim 1 wherein the at least one attachment point on the guide arm comprises a circular opening in at least one end of the guide arm, and the anchor member comprises a disc-shaped body sized and shaped to be slidably received in the circular opening of the guide arm to provide a pivot point for the guide arm to rotate across the surface of the fabric.

5. The assembly of claim 1 wherein the stabilizing pin has two opposing ends and is structured to be inserted into the material under the prong and then back up on top of the fabric with both ends of the stabilizing pin on top of the material.

6. The assembly of claim 1 wherein the guide arm comprises an elongate body and the at least one attachment point comprises a first opening adjacent a first end of the elongate body and a second opening adjacent a second end of the elongate body.

7. An system for use with cloth material, comprising:

a template having at least one engagement point on the template;

a stabilizing pin; and an anchor member structured to be releasably coupled to the fabric material and to be releasably engaged with the engagement point on the template to provide a pivot point for the template to rotate about the anchor member when the anchor member is attached to the fabric material, the anchor member including a prong extending therefrom, the prong having a notch sized and shaped to receive the stabilizing pin and lock the prong and the anchor member in place on the material.

8. The system of claim 7 wherein the stabilizing pin has two opposing ends and is structured to be inserted into the material under the prong and then back up on top of the fabric with both ends of the stabilizing pin on top of the material.

9. The system of claim 7 wherein the prong extends from a bottom surface of the anchor member and has an "L" shape comprising an extension leg and an engagement foot extending at an angle from the extension leg, the extension leg including the notch.

10. The system of claim 7 wherein the at least one engagement point on the template comprises a circular opening in the template, and the anchor member comprises a disc-shaped body sized and shaped to be slidably received in the circular opening of the guide arm to provide a pivot point for the template to rotate on top of the surface of the fabric.

11. An anchoring apparatus for anchoring a template having an engagement point to fabric material, the apparatus comprising:

a stabilizing pin; and an anchor member structured to be releasably coupled to the fabric material and to be releasably engaged with the engagement point on the template to provide a pivot point for the template to rotate about the anchor member when the anchor member is attached to the fabric material, the anchor member including a prong extending therefrom, the prong having a notch sized and shaped to receive the stabilizing pin and lock the prong and the anchor member in place on top of the fabric material.

12. The apparatus of claim 11 wherein the stabilizing pin has two opposing ends and is structured to be inserted into the material under the prong and then back up on top of the fabric with both ends of the stabilizing pin on top of the material.

13. The apparatus of claim 12 wherein the prong extends from a bottom surface of the anchor member and has an "L" shape comprising an extension leg and an engagement foot extending at an angle from the extension leg, the extension foot including the notch.

14. The apparatus of claim 11 wherein the at least one engagement point on the template is a circular opening in the template, and the anchor member comprises a disc-shaped body sized and shaped to be slidably received in the circular opening of the template to provide a pivot point for the template to rotate on top of the surface of the fabric.

15. A template, comprising:

an elongate body having first and second mutually opposing ends and first and second elongate sides, a front face and a mutually opposing planar back face;

a first arm extending in a first direction from the first side of the body, the first arm having a first side edge formed at an obtuse angle to the first side of the body and a second side edge formed at an acute angle to the body; and a second arm extending in a second direction from the first end of the body, the first arm having a first side edge formed at an acute angle to the second side of the body and a second side edge formed at an obtuse angle to the body;

a first foot formed on the first arm;

a second foot formed on the second arm;

a third foot formed on the second end of the body.

16. The template of claim 15, further comprising an engagement point formed on the template that comprises an opening formed through the body of the template in communication with the front and back faces of the body.

* * * * *